US006612358B2

(12) United States Patent
Hay et al.

(10) Patent No.: US 6,612,358 B2
(45) Date of Patent: Sep. 2, 2003

(54) DUAL TRACK STORM DOOR

(75) Inventors: Bill R. Hay, Albert Lea, MN (US); Kelly D. Nordgaard, Clear Lake, SD (US); Allen E. Lee, Brookings, SD (US); Bryan P. Zacher, Brookings, SD (US)

(73) Assignee: Larson Manufacturing Company, Brookings, SD (US)

( * ) Notice: Subject to any disclaimer, the term of this patent is extended or adjusted under 35 U.S.C. 154(b) by 0 days.

(21) Appl. No.: 09/861,933

(22) Filed: May 21, 2001

(65) Prior Publication Data

US 2002/0029525 A1 Mar. 14, 2002

Related U.S. Application Data

(60) Provisional application No. 60/209,689, filed on Jun. 6, 2000.

(51) Int. Cl.[7] ..... A47H 1/00
(52) U.S. Cl. ..... 160/90; 49/164; 49/489.1
(58) Field of Search ..... 160/90, 101; 49/163, 49/164, 166, 168, 489.1

(56) References Cited

U.S. PATENT DOCUMENTS 1,283,918 A * 11/1918 Romuender
2,914,121 A * 11/1959 Taylor
4,416,089 A * 11/1983 Lambke, Jr.
4,856,243 A * 8/1989 Ault et al.
5,039,246 A 8/1991 Woodruff et al.
5,797,223 A * 8/1998 Shoup et al.
6,256,931 B1 * 7/2001 Kenkel et al.
6,363,659 B1 * 4/2002 Wang

OTHER PUBLICATIONS

Columbia Manufacturing Corp., Screen Doors, published more than one year before Jun. 6, 2000.

* cited by examiner

*Primary Examiner*—Blair M. Johnson
(74) *Attorney, Agent, or Firm*—Welsh & Katz, Ltd.

(57) ABSTRACT

A two track storm door exhibits three track-like features. A rectangular frame defines an open bounded region. A screen fills the open region. Two glass panes, one for each track, are movable independently of one another to close or open the region. A spline secures the screen within the frame and a bearing surface is provided by the spline against which one of the panes bears.

7 Claims, 9 Drawing Sheets

Fig. 2
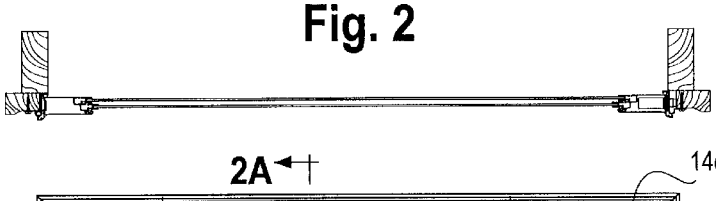
Fig. 2A
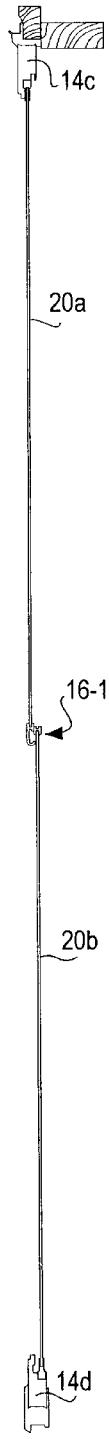
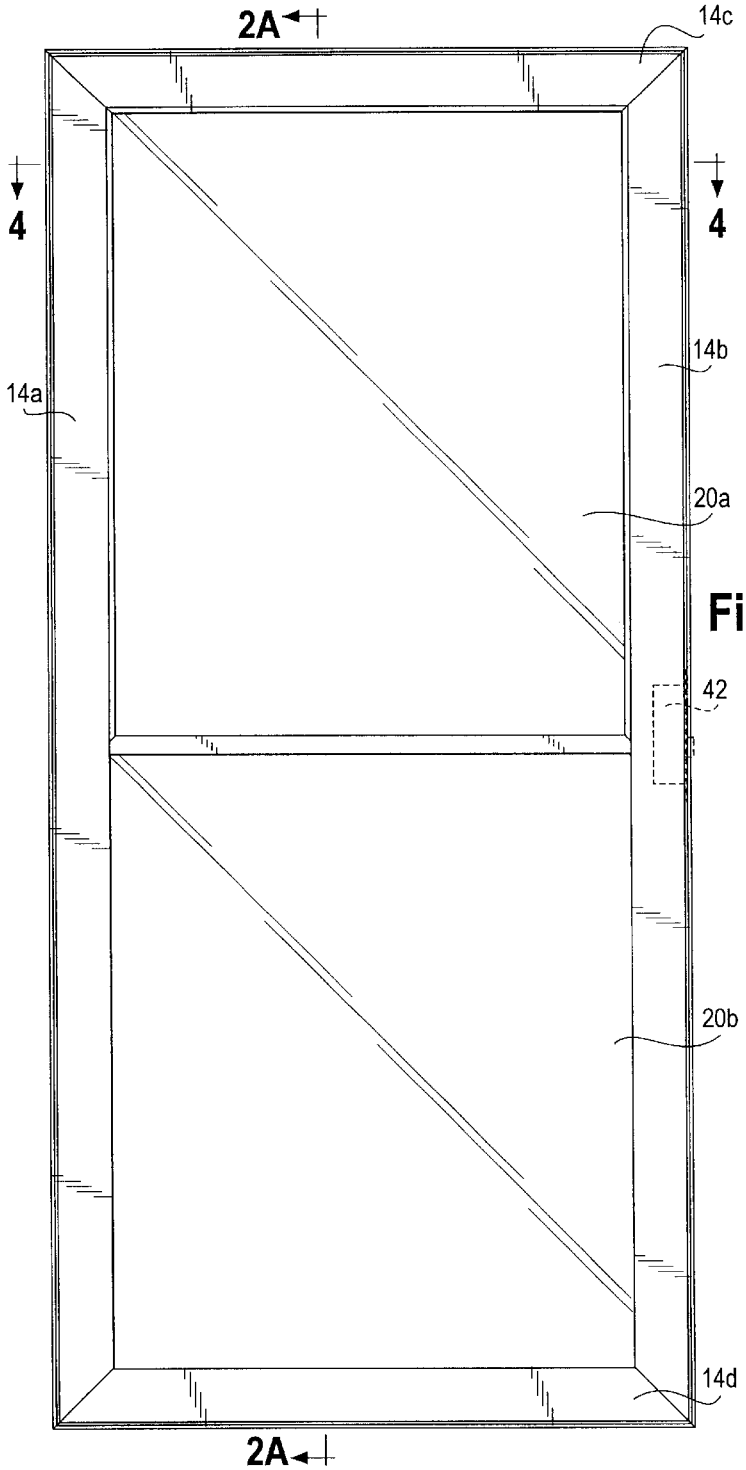
Fig. 1

DUAL TRACK STORM DOOR

This application is a Utility Application claiming the benefit of the earlier filing date of Provisional Application Ser. No. 60/209,689, filed Jun. 6, 2000.

FIELD OF THE INVENTION

The invention pertains to multi-track storm doors having movable panes. More particularly, the invention pertains to such doors which incorporate two tracks for pane movement.

BACKGROUND OF THE INVENTION

Storm doors with movable/storable panes of glass are known. Many such doors provide a fixed screen and a pane movable to open or close the screen.

Storm doors with removable, interchangeable panes and screens are also known. Full length and half-length panes and screens can be interchanged to provide a full glass door in cold weather and half or full screen doors in warm weather.

Triple track storm windows are also known. Such windows combine the advantages of double hung, independently movable panes with a movable screen.

Triple track storm windows while effective in fixed installations are heavy and present mounting problems in doors. While known doors can be opened or converted to screens, their flexibility and ease of use could be improved.

There continues to be a need for more versatile storm doors. Preferably such improvements could be made without substantially increasing door cost or weight. In addition, it would be preferable if ease of use and convenience could also be enhanced.

SUMMARY OF THE INVENTION

A storm door incorporates first and second independently movable glass panes. The door has an elongated rectangular frame which bounds an interior region. A screen carried by the door covers the internal region.

The frame carries pairs of first and second tracks. One pair of tracks extends along each elongated side of the frame.

One glass pane is slidable along one track. A second is slidable, independently of the position of the first pane, along the second track. One of the panes is sandwiched between the screen and the other pane.

In one embodiment, the elongated sides of the frame are oriented so as to be substantially perpendicular to a horizontal plane. The panes can be moved vertically between upper and lower positions.

In one state, the panes completely close the interior region substantially blocking any flow therethrough. In a second state, one pane can be moved down to permit air to flow through an upper section of the screen. In a third state, one pane can be moved up to permit air to flow through a lower section of the screen. Finally, both panes can be moved down and up, respectively to permit simultaneous upper and lower air flow through the screen while only needing two inserts.

Latches can be used to lock the panes at selected locations. Minimal overlaps exist between the panes in one state, where the panes cover the interior region. As the interior region is uncovered, or opened to permit air to flow through, the panes relatively move toward one another and the overlap increases.

Advantages of the present door configuration include:

1. readily manufacturable and cost effective due to incorporating features, such as the screen, into the door frame; and
2. reduction in needed material due to incorporating necessary features into the frame.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 1 is a front elevational view of a door in accordance with the present invention;

FIG. 2 is a sectional view of the door of FIG. 1 taken along plane 2—2 of FIG. 1;

FIG. 2A is a sectional view of the door of FIG. 1 taken along plane 2A—2A of FIG. 1;

DETAILED DESCRIPTION OF THE PREFERRED EMBODIMENTS

Figure 3A:
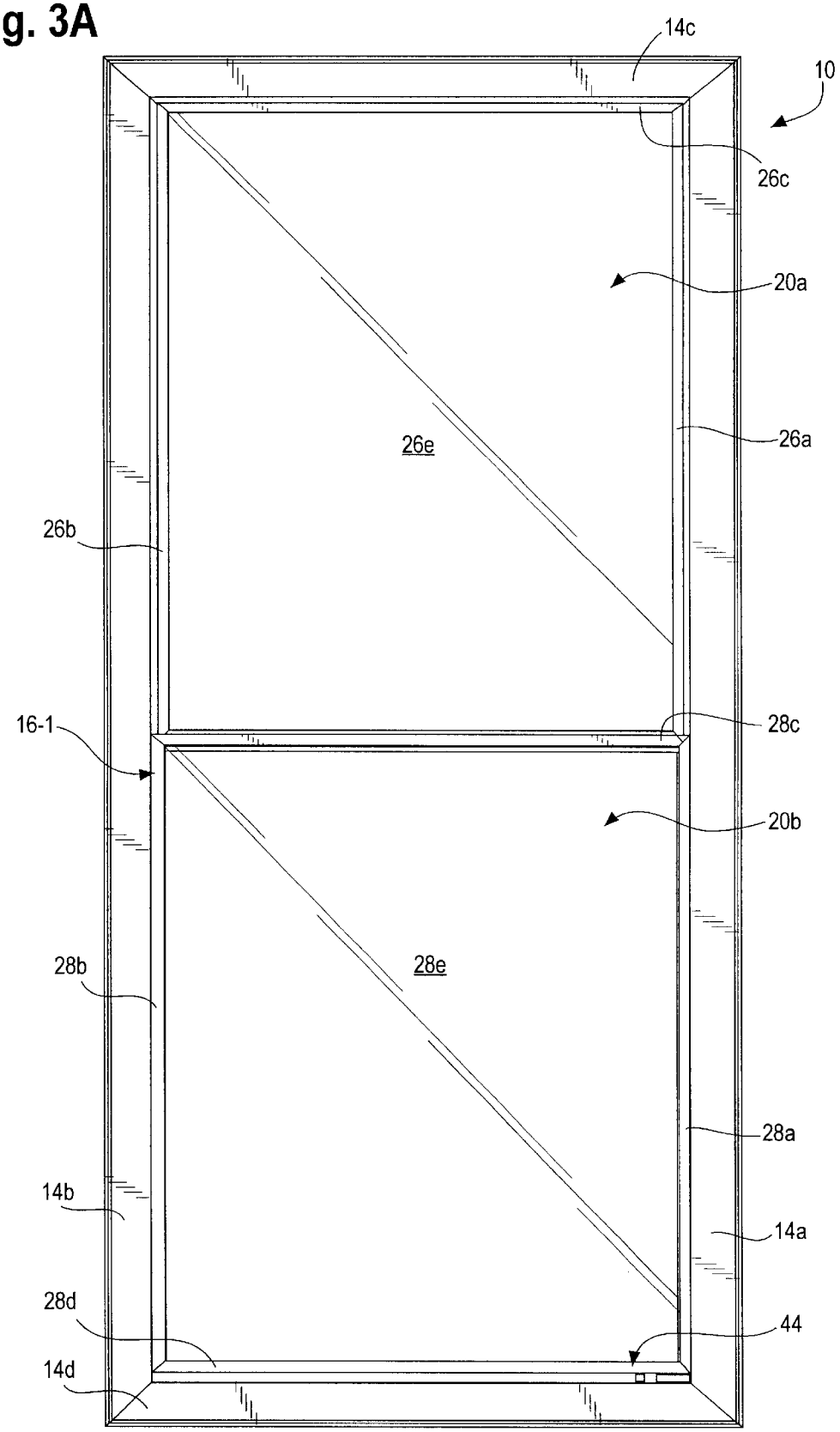
FIGS. 3A–D taken together illustrate rear elevational views of the door of FIG. 1 in different ventilating conditions.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

The figures illustrate the various aspects of a storm door 10 in accordance with the present invention. The door 10 includes a frame 14 having elongated, generally vertical sides 14*a, b* with top and bottom sections 14*c,d*.

The frame 14 bounds an interior region 16. The region 16 is covered, in part, by upper pane assembly 20*a*, and lower pane assembly 20*b*. The region 16 is completely covered by screen 20*c*.

Each frame side 14*a,b* carries a respective track pair 22*a,b* and 24*a,b*. The tracks enable independent, vertical movement of each of the pane assemblies 20*a,b*. The tracks 22*a*, 24*a* are spaced further apart, as discussed in more detail subsequently, than are the tracks 22*b*, 24*b*.

Each pane assembly 20*a,b* includes bounding elements such as extruded aluminum elements 26*a,b,c,d* and 28*a,b, c,d*. In each instance, a window 26*e* and 28*e* is carried by respective bounding elements. The bounding elements carry respective whether strip retaining recesses such as recesses 30*a,b* and 32*a,b*.

Screen 20*c* is locked to frame 14 by spline 36. The spline 36 retains the screen 20*c* in the frame by slidably clamping the screen 20*c* into spline receipt regions, such as 38*a,b* in respective frame elements 14*a,b*. Exterior surfaces 36*a,b* of the spline 36 each provide a slider pad for the adjacent pane assembly 20*a*. This interaction also protects the screen 20*c* from a moving pane assembly or sash.

Door 10 can be rotatably installed in frame 40 which can in-turn be installed in door opening D. The door 10 can include an internally located mortise lock 42. Alternately, an exterior, surface mount lock could be used.

Figure 3B:
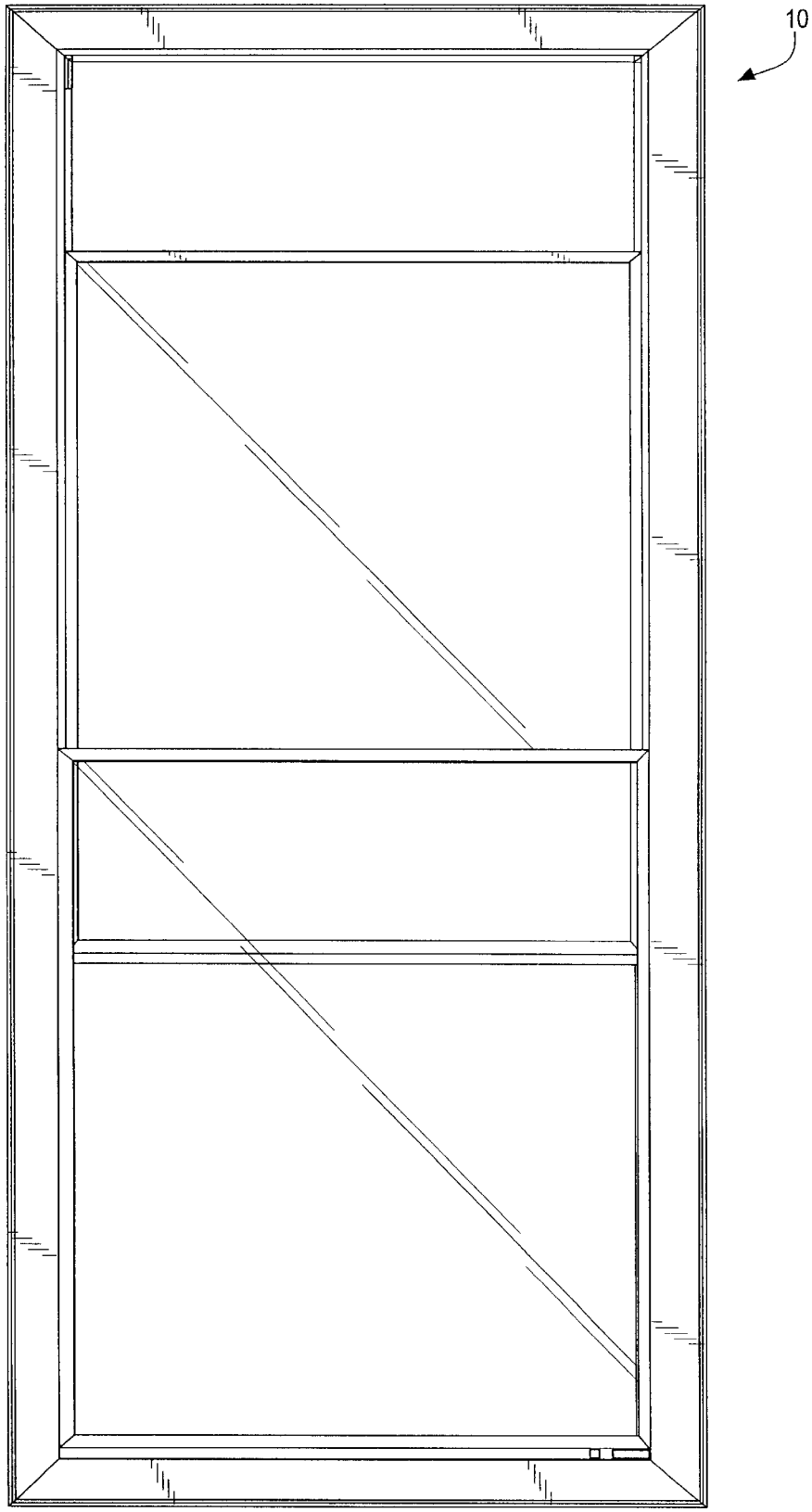
Figure 3C:
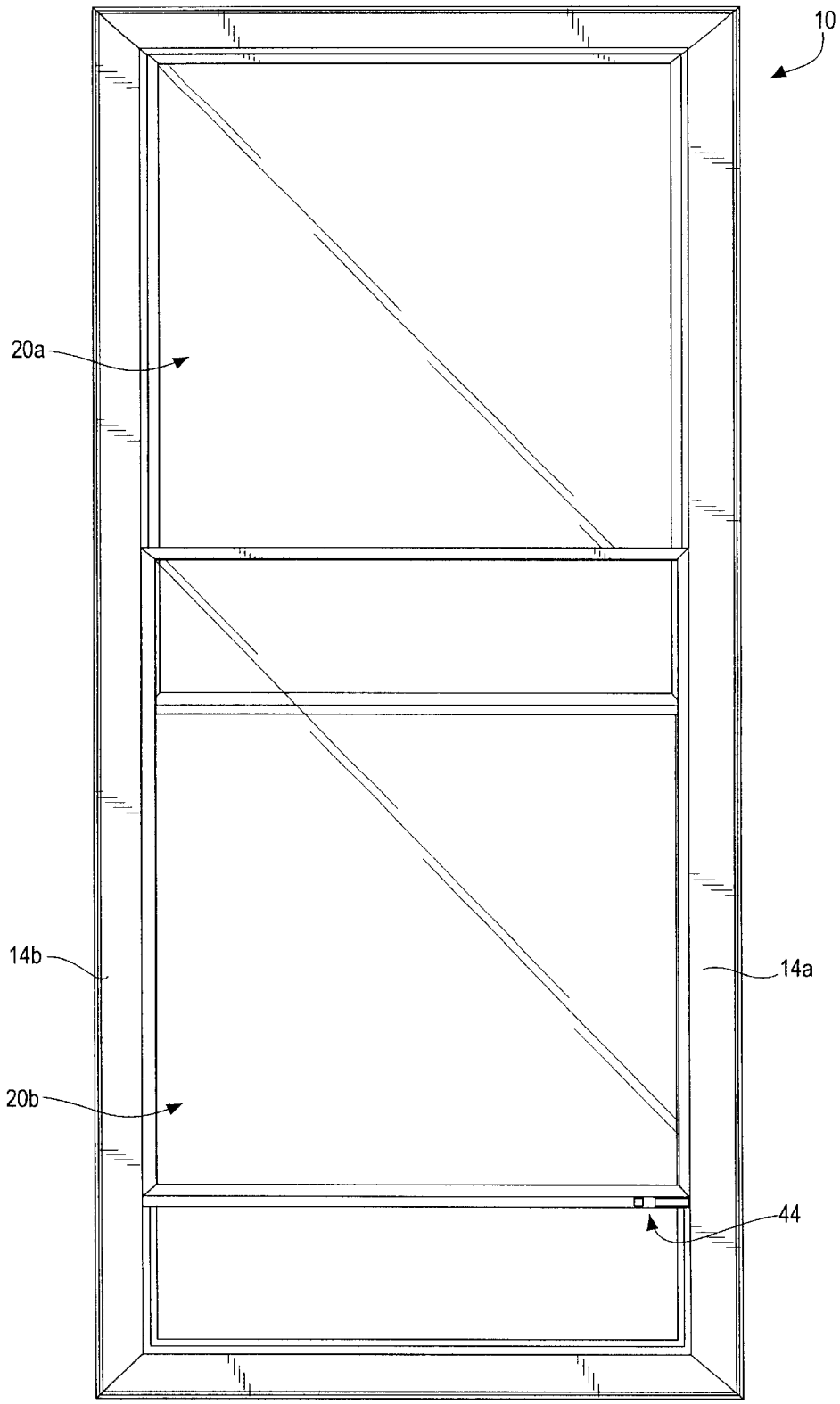
Figure 3D:
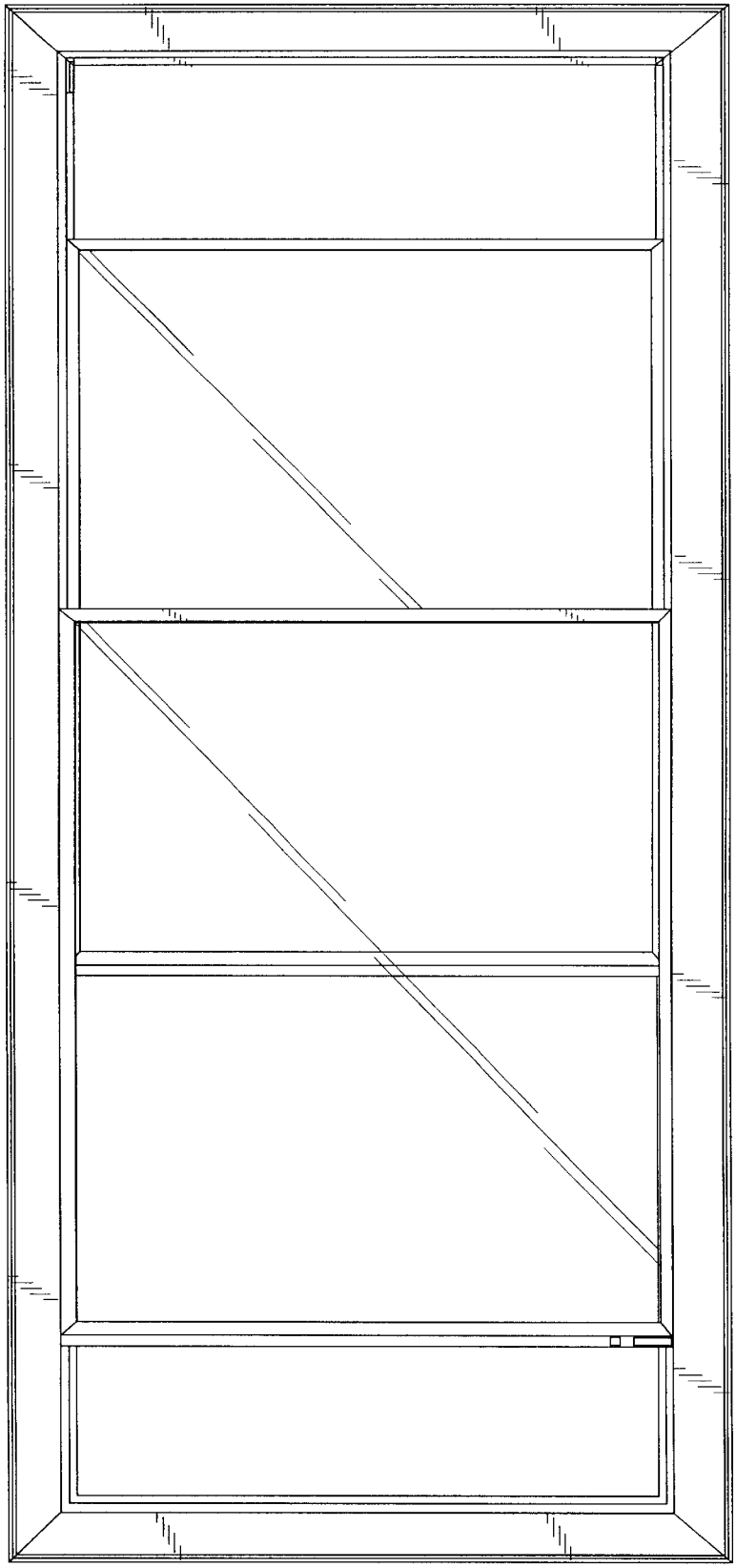
Figure 4:
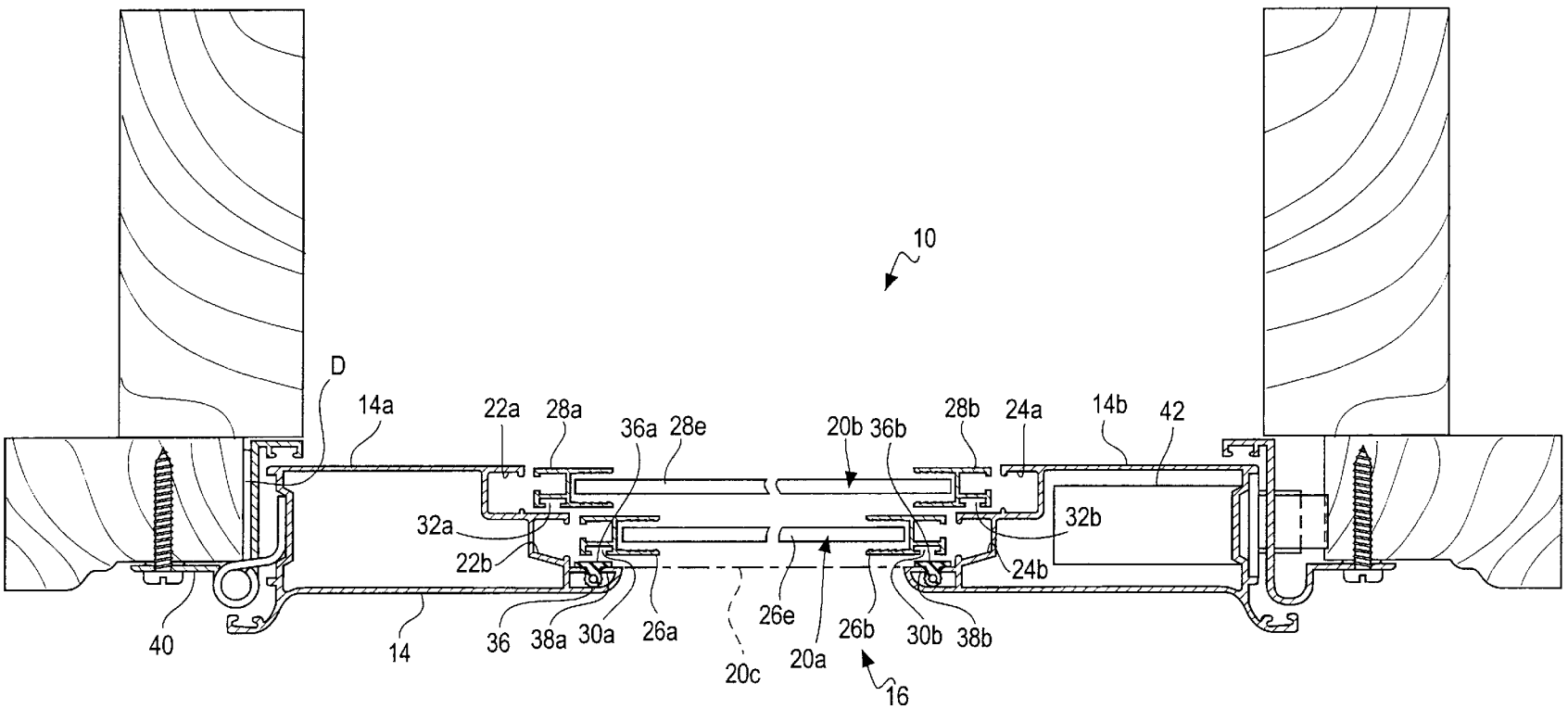
FIG. 4 is a sectional view of the door of FIG. 1 taken along plane 4—4 of FIG. 1.
Figure 5:
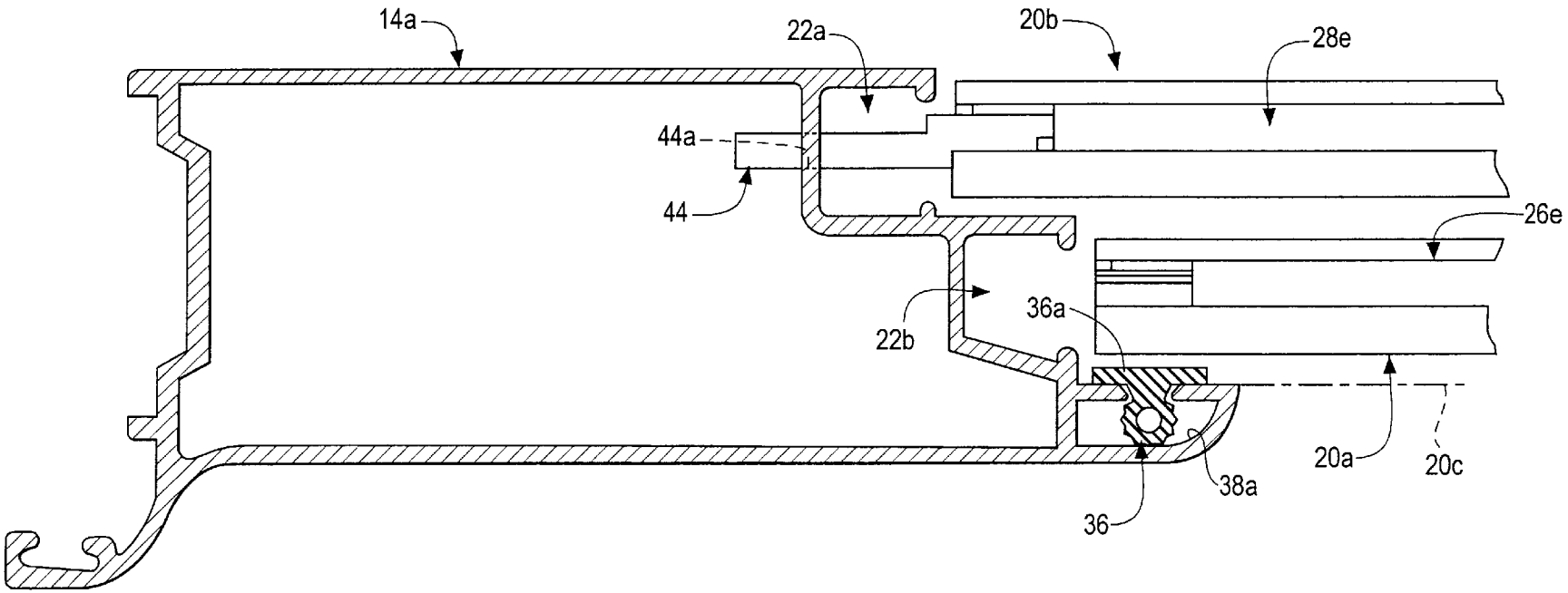
FIG. 5 is an enlarged fragmentary view of a portion of FIG. 4.
Figure 6:
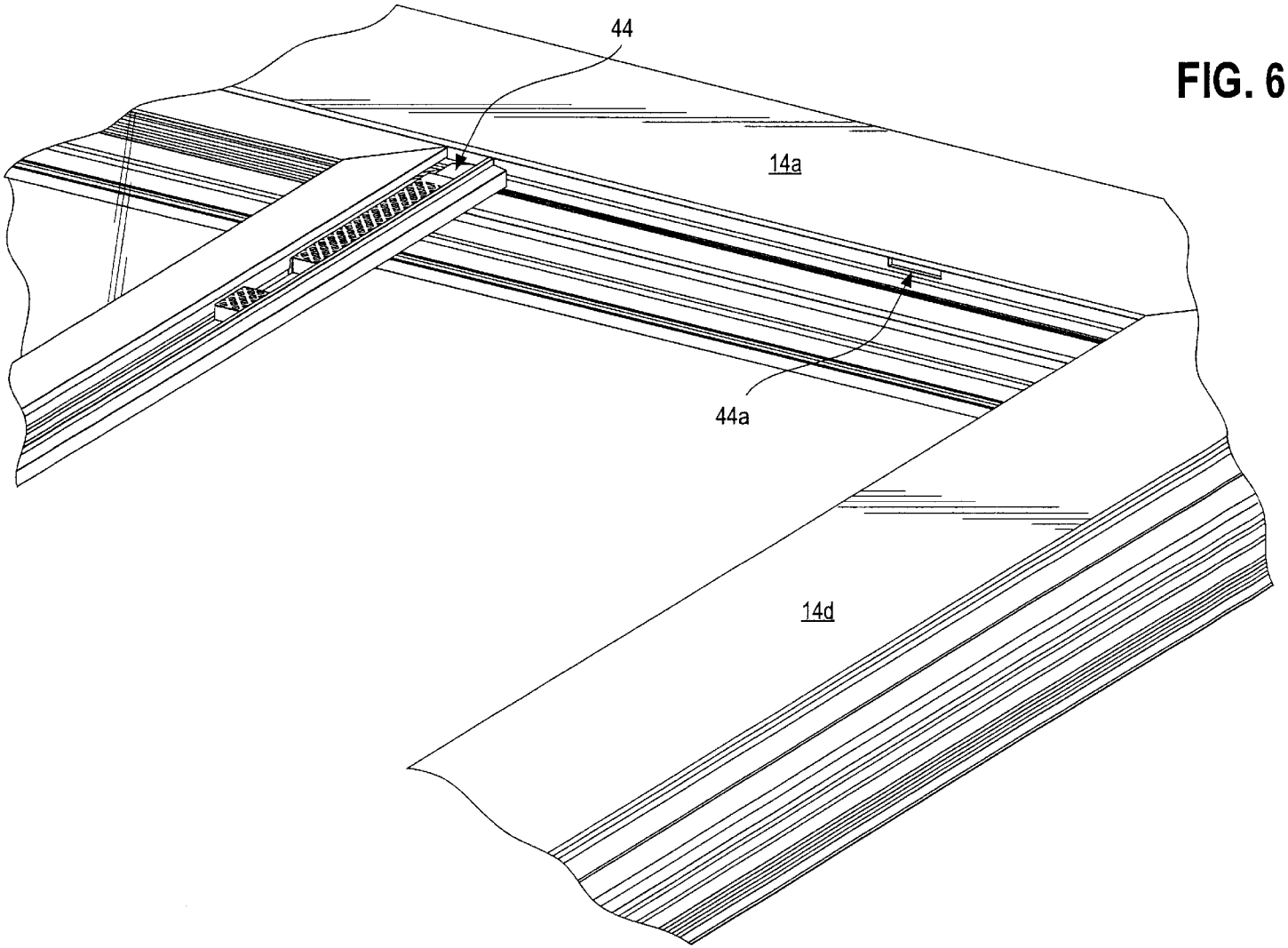
FIG. 6 is an isometric view of a lower right corner with the lower pane positioned for ventilation.
Figure 7:
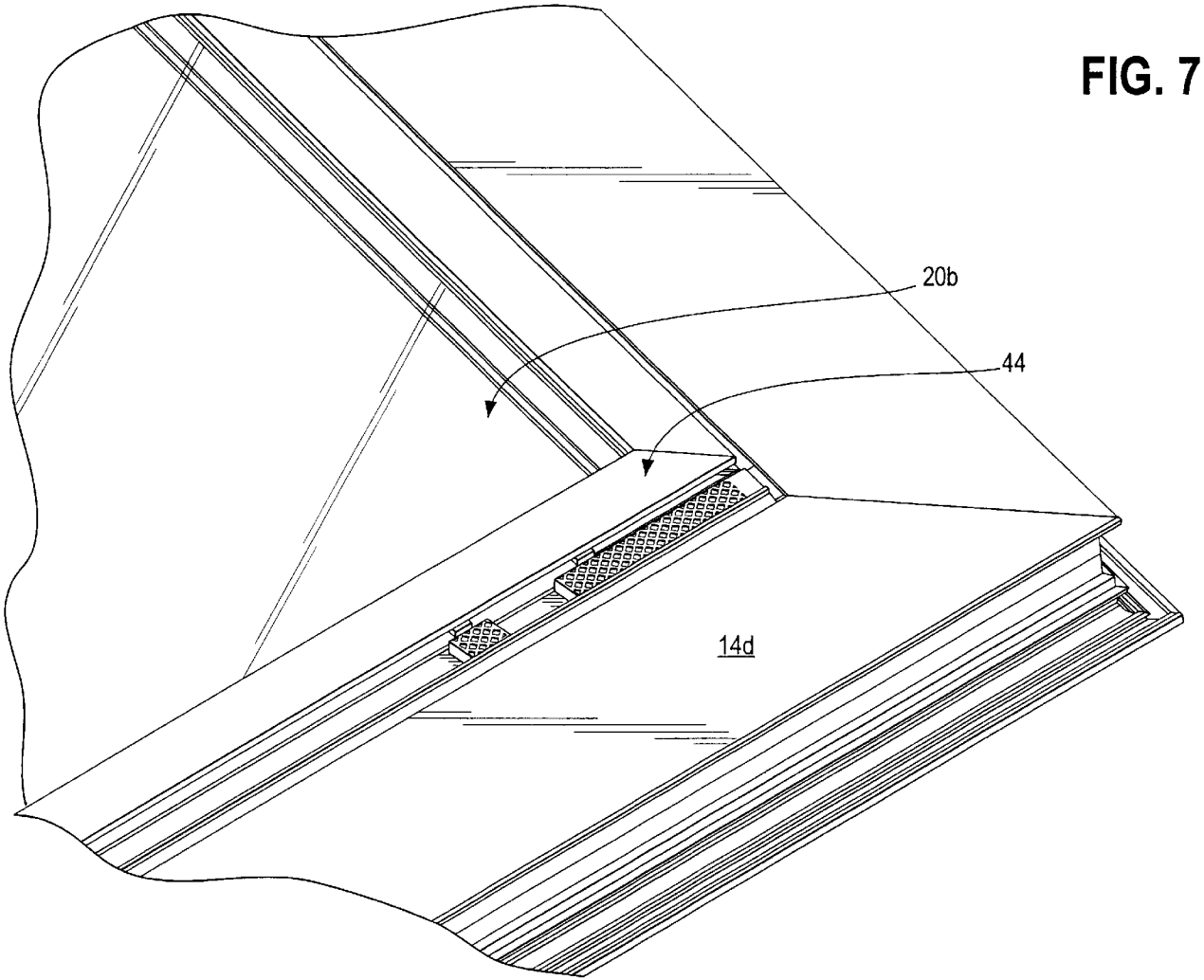
FIG. 7 is an isometric view of a lower right corner with the lower pane closed.

The pane assemblies can be positioned with minimal overlap, see FIG. 3A. In this configuration, region 14 is closed and breezes can not flow through screen 16. Alternate configurations illustrated in FIGS. 3B,C,D provide for top, bottom or duel ventilation. This variety of configurations is achieved using only two sets of tracks and two inserts, pane assemblies 20*a,b*. The door 10 thus provides three track-like features with only two tracks.

It will be understood that the pane assemblies 20*a,b* can be retained in the respective set of tracks in a variety of ways as would be known to those of skill in the art. One way is to use spring loaded latches, such as latch 44, which engage openings, such as 44*a*, in the respective frame members 14*a,b*. Other retaining mechanisms can be used without departing from the spirit and scope of the present invention.

In the closed configuration, FIG. 3A, the pane 20*a, b* assemblies overlap slightly near the center 16-1 of the screen 20*c*. This overlap prositions a generally horizontally extending weather strip between the pane assemblies to contribute to sealing the door from exterior weather conditions.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A multi-pane door comprising:

a rectangular frame which defines an open interior region;

a spline receiving aperture in the frame, bounding the region;

a screen covering the region;

a spline located, in part, in the aperture clamping the screen to the frame wherein the spline has a bearing surface;

an exterior pane track, adjacent to the spline, bounding at least first and second sides thereof;

an exterior pane, slidable along the track in contact with the bearing surface.

2. A door as in claim 1 which includes an interior pane track, parallel to and adjacent to the exterior pane and further from the screen, and, an interior pane, slidable along the interior track whereby the panes can exhibit a first state, with minimal overlaps, closing the region, and, at least a second state with greater overlap between the panes to open the screen and to provide ventilation therethrough.

3. A door as in claim 2 wherein ventilation can be selectively provided near first and second ends of the frame by displacing one or both panes toward the other.

4. A door as in claim 2 wherein a width parameter of the interior pane is greater than a width parameter of the exterior pane.

5. A multi-pane door comprising:

a rectangular frame which defines an open interior region;

a spline receiving aperture in the frame, bounding the region;

a screen covering the region;

a spline located, in part, in the aperture clamping the screen to the frame wherein the spline has a bearing surface;

an exterior pane track, adjacent to the spline; and which includes an exterior pane, slidable along the track in contact with the bearing surface.

6. A door as in claim 5 which includes an interior pane track, adjacent to the exterior pane track and parallel thereto with the exterior pane track between the spline and the interior pane track.

7. A door as in claim 6 includes an interior pane, wider than the exterior pane, and slidable along the interior pane track.

* * * * *